US009472144B2

(12) United States Patent
McRae et al.

(10) Patent No.: US 9,472,144 B2
(45) Date of Patent: Oct. 18, 2016

(54) CONTROLLING COLOR AND WHITE TEMPERATURE IN AN LCD DISPLAY MODULATING SUPPLY CURRENT FREQUENCY

(71) Applicant: Vizio Inc., Irvine, CA (US)

(72) Inventors: Matthew McRae, Laguna Niguel, CA (US); William Pat Price, Henderson, TX (US); Ken Lowe, San Juan Capistrano, CA (US)

(73) Assignee: Vizio Inc, Irvine, CA (US)

( * ) Notice: Subject to any disclaimer, the term of this patent is extended or adjusted under 35 U.S.C. 154(b) by 0 days.

(21) Appl. No.: 14/666,629

(22) Filed: Mar. 24, 2015

(65) Prior Publication Data

US 2015/0199935 A1 Jul. 16, 2015

Related U.S. Application Data

(63) Continuation of application No. 13/844,845, filed on Mar. 16, 2013, now Pat. No. 8,988,340.

(51) Int. Cl.
*G09G 3/36* (2006.01)
*G09G 3/34* (2006.01)

(52) U.S. Cl.
CPC ..... *G09G 3/3607* (2013.01); *G09G 3/3413* (2013.01); *G09G 2320/0666* (2013.01); *G09G 2320/0686* (2013.01)

(58) Field of Classification Search
CPC ..... G09G 2320/0242; G09G 2320/0666; G09G 3/36; G09G 2320/0686; G09G 3/3607; G09G 3/3413
USPC ..... 345/101, 102; 349/65, 69–72; 362/97.1–97.3
See application file for complete search history.

(56) References Cited

U.S. PATENT DOCUMENTS

| | | | | |
|---|---|---|---|---|
| 4,748,497 | A | 5/1988 | Sengoku | |
| 5,241,374 | A | 8/1993 | Yang et al. | |
| 5,345,275 | A | 9/1994 | Lendaro | |
| 6,078,732 | A | 6/2000 | Beretta | |
| 6,517,226 | B1 | 2/2003 | Zimmermann et al. | |
| 6,611,249 | B1 | 8/2003 | Evanicky et al. | |
| 6,749,310 | B2 | 6/2004 | Pohlert et al. | |
| 6,816,145 | B1 | 11/2004 | Evanicky | |
| 6,824,283 | B2 | 11/2004 | Pohlert et al. | |
| 6,948,823 | B2 | 9/2005 | Pohlert et al. | |
| 7,119,500 | B2 * | 10/2006 | Young | H05B 33/0818 315/224 |
| 7,359,026 | B2 * | 4/2008 | Bullwinkel | G09G 3/3406 349/150 |
| 7,605,809 | B2 * | 10/2009 | Wey | H05B 33/086 315/185 S |

(Continued)

OTHER PUBLICATIONS

Yonghua Chen et al., "Effect of multi-walled carbon nantubes on electron injection and charge generation in AC field-induced polymer electroluminescence" http://en.wikipedia.org/wiki/Color_temperature, Mar. 15, 2013.

*Primary Examiner* — Lun-Yi Lao
*Assistant Examiner* — Kelly B Hegarty
(74) *Attorney, Agent, or Firm* — Law Office of Scott C Harris, Inc

(57) ABSTRACT

A display system, having an emissive body, emitting light in a way that is color temperature controllable. The light emission can be from zones. The emissive body can be a FIPEL type device with a first transparent conductive coating over a light emitting substrate. The zones are each separately controllable for color temperature.

22 Claims, 6 Drawing Sheets

FIPEL Zone Dimming Color Balance Panel Back View

(56) References Cited

U.S. PATENT DOCUMENTS 7,874,701 B2 1/2011 Pohlert et al.
8,619,155 B2 12/2013 Nakagawara
8,681,190 B2 3/2014 Yano et al.
8,692,450 B2 4/2014 Lin et al.
2002/0163529 A1 11/2002 Evanicky
2004/0036708 A1 2/2004 Evanicky et al.
2006/0076908 A1 4/2006 Morgan et al.
2006/0125373 A1 6/2006 Lin et al.
2007/0085816 A1 4/2007 Evanicky et al.
2008/0018798 A1* 1/2008 Park ..... G09G 3/2003 348/655
2008/0042558 A1* 2/2008 Buchhauser ..... H01L 27/3225 313/504
2008/0068404 A1* 3/2008 Ishii ..... G09G 3/20 345/690
2008/0170004 A1* 7/2008 Jung ..... G09G 3/3233 345/76
2008/0303918 A1 12/2008 Keithley
2009/0002604 A1* 1/2009 Morimoto ..... F21V 9/10 349/71
2009/0079359 A1* 3/2009 Shteynberg ..... H05B 33/0818 315/291
2009/0087107 A1* 4/2009 Porter ..... G09G 3/3611 382/233
2009/0097230 A1* 4/2009 Masuda ..... G02F 1/133606 362/97.2
2009/0174638 A1 7/2009 Brown
2009/0237005 A1* 9/2009 Chung ..... H05B 33/0818 315/295
2010/0020109 A1 1/2010 Belik et al.
2010/0165002 A1* 7/2010 Ahn ..... G09G 3/3648 345/690
2010/0289727 A1 11/2010 Miller et al.
2011/0254868 A1* 10/2011 Lo ..... G09G 3/22 345/690
2011/0267382 A1* 11/2011 Fergason ..... G02F 1/1336 345/690
2012/0063121 A1* 3/2012 Atkins ..... H05B 33/0848 362/97.1
2012/0069606 A1* 3/2012 Sagneri ..... H02M 3/158 363/21.02
2012/0287146 A1 11/2012 Brown et al.
2012/0313979 A1* 12/2012 Matsuura ..... G09G 3/3413 345/690
2013/0050165 A1 2/2013 Northway et al.
2013/0057938 A1* 3/2013 Natsumeda ..... G02B 5/008 359/230
2013/0215360 A1 8/2013 Pollack et al.
2014/0111560 A1* 4/2014 Yamakawa ..... G09G 3/36 345/690
2014/0124766 A1 5/2014 Song et al.
2014/0139458 A1 5/2014 Premutico et al.

* cited by examiner

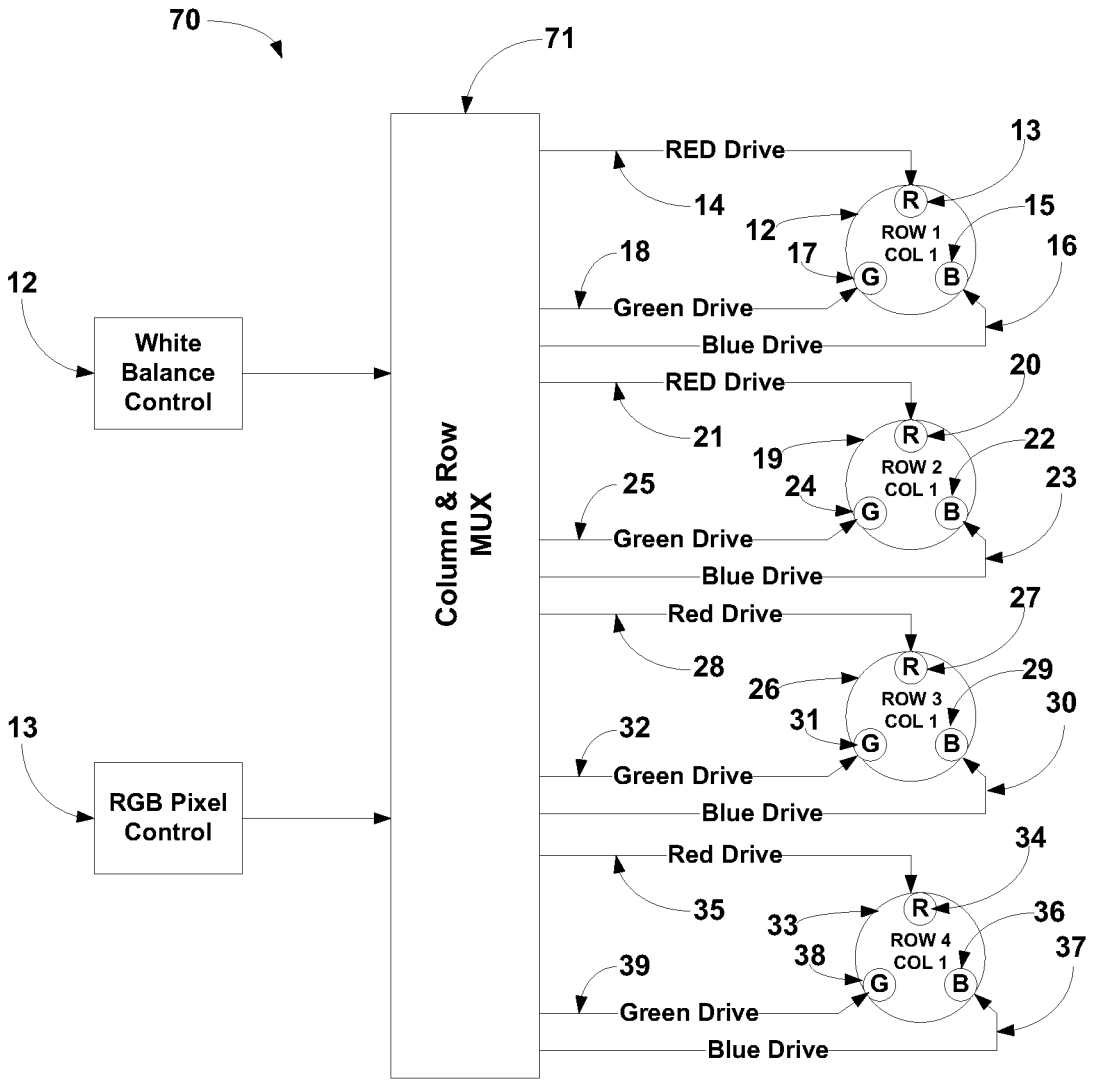
Figure 7 – Current Color Balance

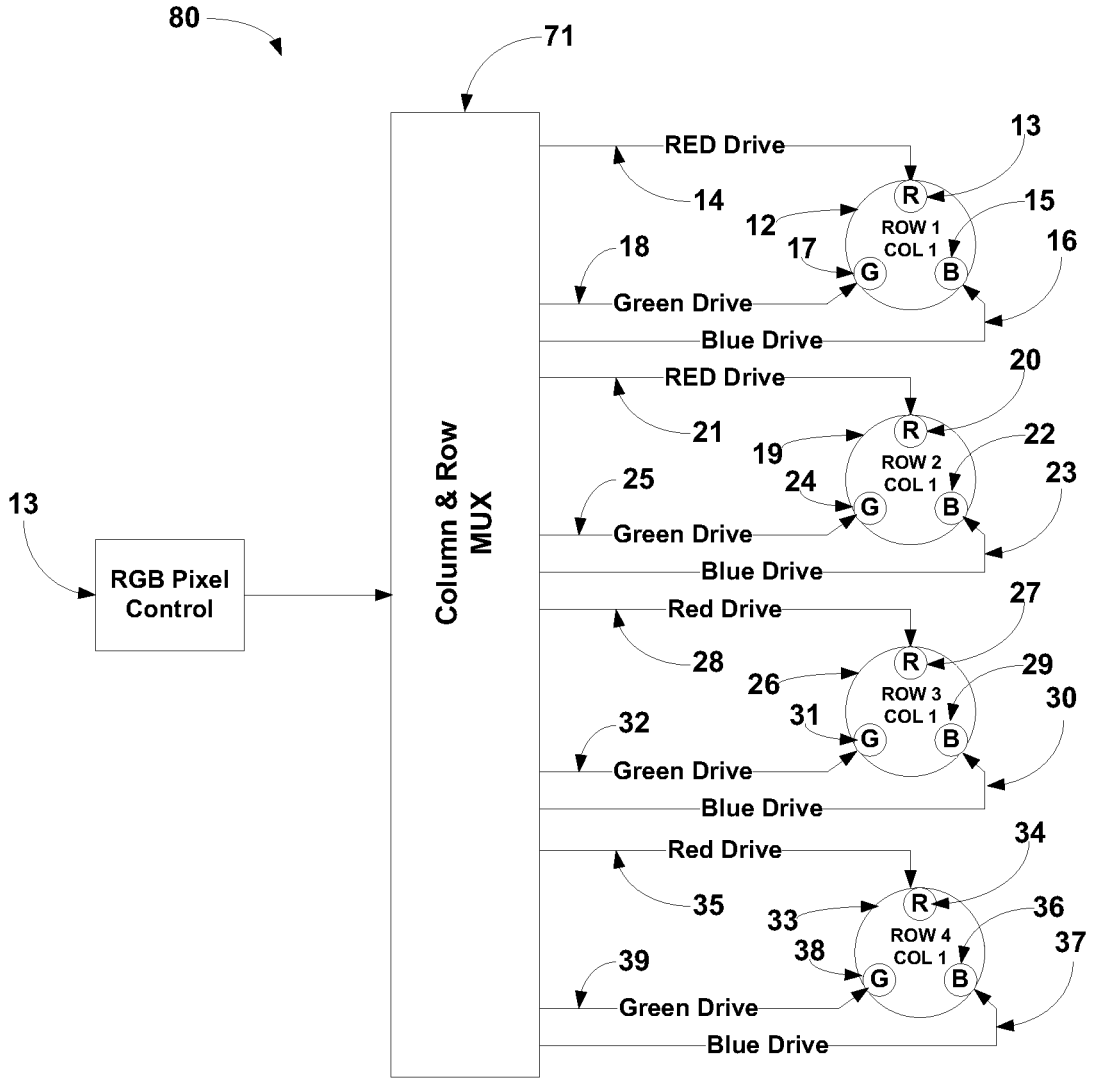
Figure 8 – Color Balance With FIPEL

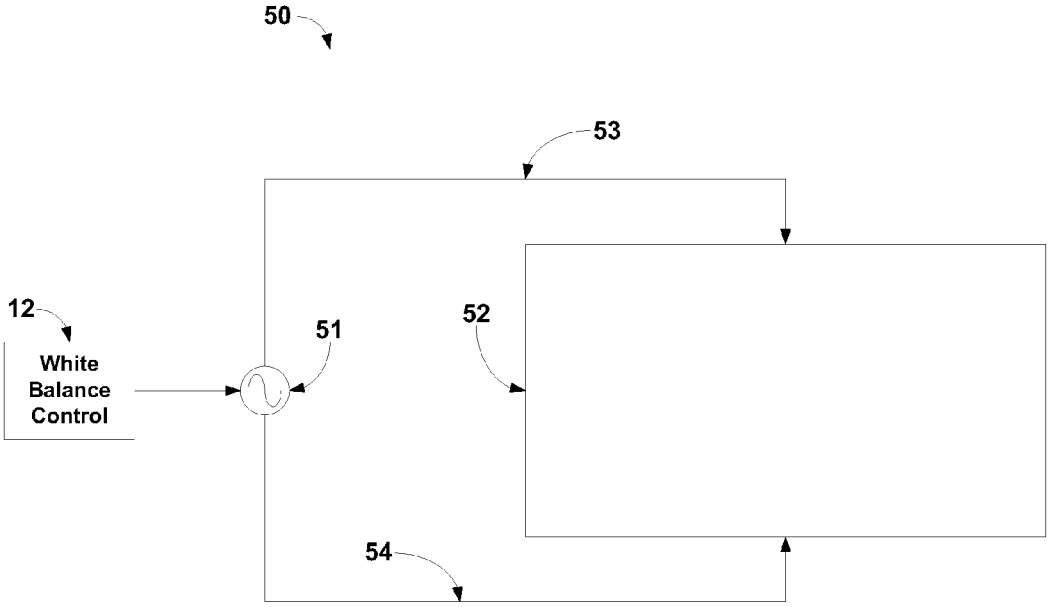
Figure 9 – Single FIPEL Color Balance Panel Backlight

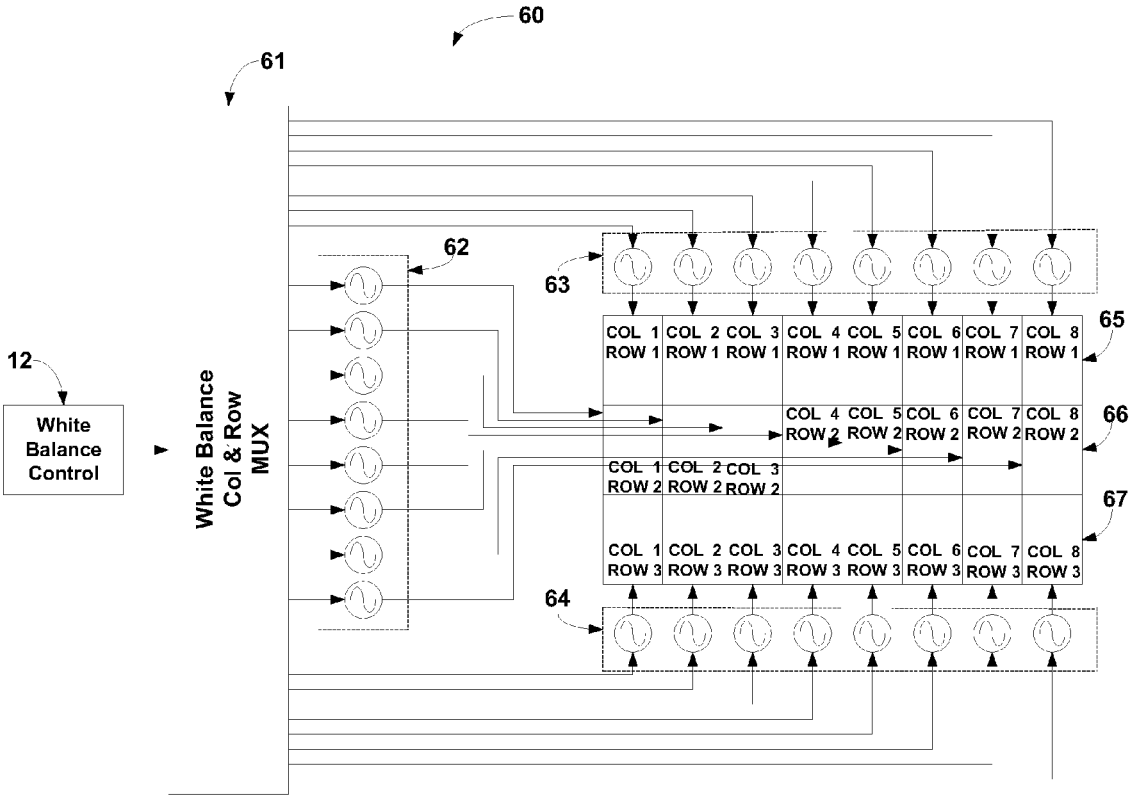
Figure 10 - FIPEL Zone Dimming Color Balance Panel Back View

CONTROLLING COLOR AND WHITE TEMPERATURE IN AN LCD DISPLAY MODULATING SUPPLY CURRENT FREQUENCY

CROSS-REFERENCE OF RELATED APPLICATION

This application is a continuation application of U.S. Ser. No. 13/844,845 filed Mar. 16, 2013, now U.S. Pat. No. 8,988,340 issued Mar. 24, 2015, the disclosure of the parent application is hereby incorporated by reference, in its entirety.

BACKGROUND

Current methods for setting white point or white balance for managing color accuracy in televisions with LCD display panels falls into a somewhat acceptable category. Circuitry for attempting to maintain color balance with current LCD televisions requires additional electronic components and power usage to run the circuitry which falls short at providing dynamic white point balance.

White point balance or color balance on televisions relates to color temperature. Color temperature is a characteristic of visible light that has important applications in lighting, photography, videography, publishing, manufacturing, astrophysics, horticulture, and other fields. The color temperature of a light source is the temperature of an ideal black body radiator that radiates light of comparable hue or color to that of the light source. In practice, color temperature is only meaningful for light sources that do in fact correspond somewhat closely to the radiation of some black body, i.e. those on a line from reddish/orange via yellow and more or less white to bluish white. Color temperature is conventionally expressed in degrees of Kelvin.

Color temperatures over 5,000K are called cool colors (blueish white), while lower color temperatures (2,700-3,000 K) are called warm colors (yellowish white through red).

NTSC and PAL TV norms call for a compliant TV screen to display an electrically black and white signal (minimal color saturation) at a color temperature of 6,500 K. Consumer-grade televisions noticeable deviate from this standard. Higher-end consumer-grade televisions generally have their color temperatures adjusted to 6,500 K by using a preprogrammed setting or a custom calibration. This setting is generally set at the factory. Some televisions will also have different preset points customized for retail display, normal, games, sports, etc.

Retail television modes have color temperatures that are higher around 11,000 Kelvin which puts the temperature into blue hues. The side effect of this is to make the picture appear brighter in high light environments which are typical in retail settings.

Current versions of ATSC explicitly call for the color temperature data to be included in the data stream, but old versions of ATSC allowed this data to be omitted. In this case, current versions of ATSC cite default colorimetry standards depending on the format. Both of the cited standards specify a 6,500 K color temperature.

Current digital LCD televisions use complicated circuitry to set color balance. This is generally accomplished by increasing or decreasing the base drive level to the red and blue sub-pixels with a pixel group. Considering that a 1080p television screen has a total of 2,073,600 pixel groups with three times that many sub-pixels (each pixel group has 3 pixels that converts white light to red, blue and green).

Eliminating the calculations required to keep the blue and red pixels at some minimum level can result in savings in component counts, PCB traces and power required to run the circuitry.

SUMMARY

Applicants recognize the need to use a new simple and inexpensive method or system to dynamically manage white point balance.

An apparatus, method and system for controlling white balance and color temperature by modulating the supply current for a Field Induced ElectroLuminescence (FIPEL) backlight source are described.

BRIEF DESCRIPTION OF THE DRAWINGS

FIG. 7 is a depiction of a normal embodiment of digital LCD white balance control.

FIG. 8 is a depiction of a pixel groups where white balance control does not set a minimum level of white color balance.

FIG. 9 is a depiction of a white balance implementation on a single FIPEL backlight.

FIG. 10 is a depiction of a zone dimming white color balance implementation for a backlight with a plurality of FIPEL panels.

DETAILED DESCRIPTION

The present invention uses a lighting technology called Field Induced Polymer ElectroLuminescence, referred to as FIPEL lighting. The present invention makes us of a FIPEL panel or panels for a backlight system for LCD televisions in one embodiment.

FIPEL panels have the distinguishing feature of being able to emit colored light from any point on the CIE index. Embodiments make use of this feature of FIPEL light panels by setting the color balance of the television by varying the color of the light being transferred to the LCD array panel from a FIPEL backlight. This alleviates the necessity of controlling the color balance of the sub-pixel driver level on more than 4 million sub-pixels.

In another embodiment, the FIPEL panel color balanced backlight is divided into a plurality of individual panels where the color balance of each subpanel is separately controlled. This allows the television to change the color temperature of the different portions of the display to enhance the viewing experience.

Figure 1:
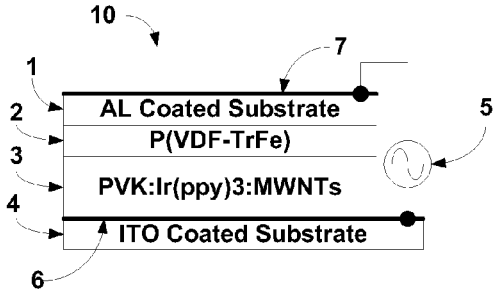
FIG. 1 is a depiction of an asymmetrical (single dielectric layer) FIPEL device that emits light from one surface.
Figure 2:
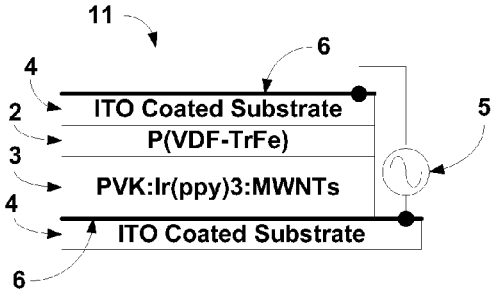
FIG. 2 is a depiction of an asymmetrical (single dielectric layer) FIPEL device that emits light from two surfaces.

To appreciate the simplicity of FIPEL devices reference FIGS. 1 through 4. FIGS. 1 and 2 illustrate single dielectric FIPEL devices. The basic construction of these FIPEL devices is discussed in the following.

Lab quality FIPEL devices are generally fabricated on glass or suitable plastic substrates with various coatings such as aluminum and Indium tin oxide (ITO). ITO is a widely used transparent conducting oxide because of its two chief properties, it is electrical conductive and optical transparent, as well as the ease with which it can be deposited as a thin film onto substrates. Because of this, ITO is used for conducting traces on the substrates of most LCD display screens. As with all transparent conducting films, a compromise must be made between conductivity and transparency, since increasing the thickness increases the concentration of charge carriers which in turn increases the material's conductivity, but decreases its transparency. The ITO coating used for the lab devices discussed here is approximately 100 nm in thickness. In FIG. 1, emissive side substrate 4 is coated with ITO coating 6 residing against PVK layer 3. In FIG. 2, ITO coating 6 is on both substrates as shown.

Figure 3:
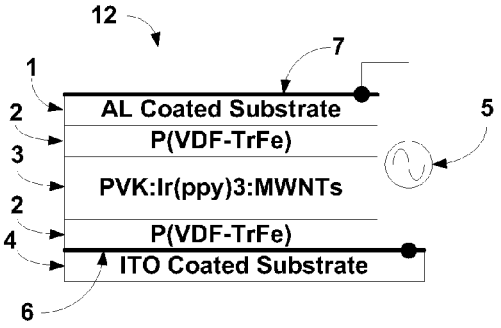
FIG. 3 is a depiction of a symmetrical (two dielectric layers) FIPEL device that emits light from one surface.
Figure 4:
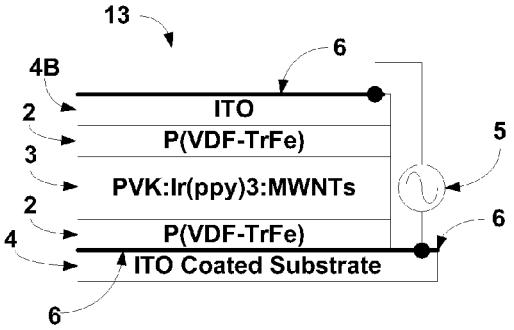
FIG. 4 is a depiction of a symmetrical (two dielectric layers) FIPEL device that emits light from two surfaces.

Substrate 1 in FIGS. 1 and 3 is coated with aluminum (AL) coating 7. The resulting thickness of the AL deposition is sufficient to be optically opaque and reflective. To ensure that any light from emissive layer 3 that travels toward substrate 1 is reflected and directed back through emissive substrate 4 with ITO coating 6 for devices illustrated in FIG. 1. If it is desired that light be emitted through both substrates, a substrate 4 with an ITO coating 6 is substituted for substrate 1 with Al coating 7 as shown in FIG. 2.

The differences between the two similar substrates is how ITO coating 6 is positioned. In FIG. 1, emissive ITO coating 6 is positioned such that ITO coating 6 on substrate 4 is physically in contact with PVK layer 3. In FIG. 2, substrate 1 with Al coating 7 (FIG. 1) is replaced with substrate 4 with ITO coating 6 not in physical contact with the P(VDF-TrFe) (dielectric layer) layer 2. This allows light to be emitted from both the top and bottom surfaces of the FIPEL device.

Dielectric layer 2 in all cases is composed of a copolymer of P(VDF-TrFE) (51/49%). The dielectric layer is generally spin coated against the non-AL coated 7 side of substrate 1 or non-ITO coated 6 of substrate 4 of the top layer (insulated side). In all cases the dielectric layer is approximately 1,200 nm thick.

Emissive layer 3 is composed of a mix polymer base of poly(N-vinylcarbazole):fac-tris(2-phenylpyri-dine)iridium (III) [PVK:Ir(ppy)3] with Medium Walled Nano Tubes (MWNT). The emissive layer coating is laid onto the dielectric layer to a depth of approximately 200 nm. For the lab devices with the greatest light output the concentration of MWNTs to the polymer mix is approximately 0.04% by weight.

Carriers within the emissive layer then recombine to form excitons, which are a bound state of an electron and hole that are attracted to each other by the electrostatic force or field in the PVK host polymer, and are subsequently transferred to the Ir(ppy)3 guest, leading to the light emission.

When an alternating current is applied across the devices shown in FIGS. 1 and 2 (asymmetrical devices containing 1 dielectric layer) the emissive layer emits light at specific wavelengths depending on the frequency of the alternating current. The alternating current is applied across the conductive side of the top substrate 1 (Al coating 7) or substrate 4 and the conductive side (ITO coating 6) of bottom substrate 4. Light emission comes from the injection of electrons and holes into the emissive layer. Holes follow the PVK paths in the mixed emissive polymer and electrons follow the MWNTs paths.

The frequency of the alternating current applied across the substrates of the FIPEL panel can also determine the color of light emitted by the panel. Any index on the CIE can be duplicated by selecting the frequency of the alternating current. Signal generator 5 may be of a fixed frequency which is set by electronic components or set by a computer process that is software controlled. In this embodiment, the controlling software may include instructions to balance white color or may determine the frequency based on hardware registers or data containing in the digital stream transporting the content to be displayed.

In a display system, a spatial light modulator, e.g., a pixel controllable LCD, is illuminated by the FIPEL lighting panel.

Figure 5:
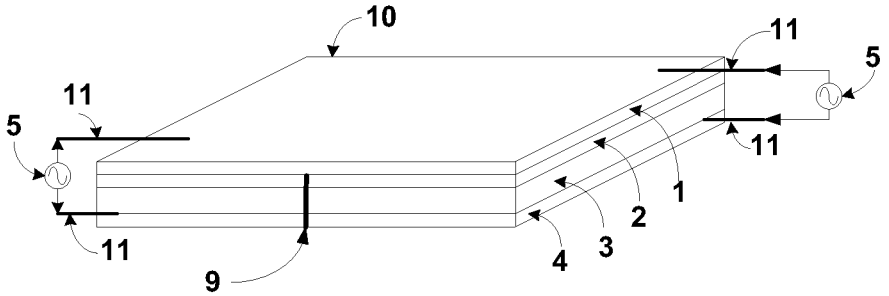
FIG. 5 is a depiction of adjacent FIPEL panels that share a common reflective substrate.
Figure 6:
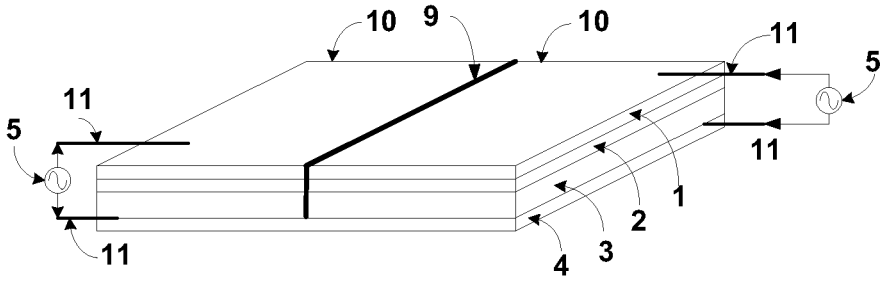
FIG. 6 is a depiction of adjacent FIPEL panels that share a common substrate on the emissive side of the panel.

FIGS. 5 and 6 illustrate an embodiment using common substrates for adjacent FIPEL panels. FIG. 5 depicts an embodiment where adjacent FIPEL panels share back substrate 1 which is coated with aluminum 7 or ITO 6. In this embodiment, common substrate 1 acts as a single signal path to all of the panels which eliminates half of the control signal traces required for the FIPEL panel thus reducing the parts count even more.

FIG. 6 depicts the embodiment where emissive substrate 4 with ITO coating 6 is used as the common substrate. In this embodiment substrate 1 with aluminum coating 7 is the controlled substrate for individual FIPEL pixels.

To fully appreciate the simplification of managing color temperature with the invention, the current methodology of managing color temperature is shown as FIG. 7—Current Color Balance.

FIG. 7 is a schematic depiction of pixels groups 1 through 4 residing in column 1. The pixels groups are referenced as 12, 19, 26 and 33. Each of the pixel groups contains 3 sub-pixels as shown in Table 1.

TABLE 1

Column Row Pixel References

| Col | Row | Pixel Group | Red Sub Pixel | Red Sub Pixel Drv Line | Blue Sub Pixel | Blue Sub Pixel Drv Line | Green Sub Pixel | Green Sub Pixel Drv Line |
|---|---|---|---|---|---|---|---|---|
| 1 | 1 | 12 | 13 | 14 | 15 | 16 | 17 | 18 |
| 1 | 2 | 19 | 20 | 21 | 22 | 23 | 24 | 25 |
| 1 | 3 | 26 | 27 | 28 | 29 | 30 | 31 | 32 |
| 1 | 4 | 33 | 34 | 35 | 36 | 37 | 38 | 39 |

Pixel Groups 1 through 4 each contain 3 sub-pixels with their associated driver lines from column and row MUX 71. Column and row MUX 71 contains circuitry which turns on gates for individual sub-pixels in rows and columns. Some column and row MUXs provide drive current to groups of rows multiple times a second. Typically, the rows and columns are scanned from the top to the bottom of the LCD array panel. For example, the number of rows in a typical HD LCD display is 1920. Some column and row MUXs will scan groups of 16 rows where half the drive current necessary for a give sub-pixel is provided by the column drivers and half by the row drivers.

White Balance Control 12 sets a base line voltage/current level for all of the Red and Blue sub-pixels contained in the display. Typically Green sub-pixels are not affected by the color balance. The white balance control 12 will, in some televisions, send the white balance voltage and current levels directly to Column & Row MUX 71. In some televisions, the white balance voltage and current levels are sent to RGB Pixel Control. In the latter case, the white balance voltage and current levels are used by RGP pixel control as the base line on top of which the control levels for gating each individual sub-pixel are added to the white balance level then sent to Column & Row MUX 71.

Column & row MUX 71 will have a drive line that runs to each sub-pixel in a given row. Column & row MUX 71 also contains row and column address gates so that individual sub-pixels are addressed. More gates are required to access more rows of sub-pixels that are addressed at a given time the This translates directly into integrated circuits and component counts. A typical 1080×1920 HD LCD display contains 2,073,600 pixel groups with 6,220,800 sub-pixels. To provide circuitry for all of these pixels to be addressed and driven at the same time would require 120 times the gating logic as opposed to the column & row MUX addressing 16 rows at the same time.

The white balance control logic typically contains gates to impress the voltage and current levels onto the red and blue sub-pixels. There are 2,160 red and blue sub-pixels in a 1080 pixel group row and if the column & row MUX addresses 16 rows at a time then there are 34,560 gates required to manage the white balance control within column & row MUX 71.

FIG. 7 shows the large number of parts that are necessary to white balance using these techniques. Removing color balance control from RGB Pixel Control 13 or from White Balance Control 12 will result in a component count savings.

FIG. 8 is a schematic depiction of pixels groups 1 through 4 residing in column 1 where the white balance control is not used for setting the color balance of individual sub-pixels. FIG. 8 is identical to FIG. 7 with the exception of the lack of White Balance Control 12.

FIG. 9 shows a depiction of a single FIPEL panel with White Balance control. In this depiction, white balance control 21 sets the basic frequency for frequency generator 51. Frequency generator 51 provides alternating current at the selected frequency to FIPEL panel 52 via control signal lines 53 and 54. In this depiction, the level of light output from FIPEL panel 52 is constant. In another embodiment, write balance control 12 may set the frequency of signal generator 52 from a preset circuit or white balance control may determine the frequency by interrogating a set of registers or by examining data contained in the digital stream transporting the digital content to be displayed.

FIG. 10 is a schematic depiction of a segmented FIPEL panel divided into 3 rows of 8 columns. This will allow the television to emit individual backlight to 24 zones of the LCD display panel. When program content contains areas of black, the FIPEL panel behind such areas of black can be dimmed or turned off thus increasing the contrast ratio between bright areas of content and dark or black areas of content.

The depiction contained in FIG. 10 represents row 1 of the FIPEL panel which contains 8 FIPEL panels by designation 65. 66 represents row 2 of the FIPEL panel and 67 represents row 3 of the FIPEL panel. 62, 63 and 64 represent groups of frequency generators controlling the basic white balanced light that will be emitted from the individual FIPEL panels. White Balance Col & Row MUX 61 need only control the white balance of 32 FIPEL light emitters rather than the 34,560 sub-pixel light emitters of a 16 row LCD panel controller as shown in FIG. 7.

White balance control 12 controls the frequency of frequency generators contained in frequency generator groups 62, 63 and 64.

The number of FIPEL panels shown in FIG. 10 is not limited to 32 panels. Depending on the number of controllable zones desired, the number of FIPEL panels may be any even multiple of horizontal rows and vertical columns. Table 2 shows the possible number of columns and rows for FIPEL panels containable in a 1080×1920 LCD television display.

It can be seen in Table 2 that it would be possible to have a FIPEL backlight where the number of FIPEL panels can range from a single panel which covers 1080 columns and 1920 rows. At the extreme of the table, it is possible to have a plurality of FIPEL panels where each panel covers 1 pixel group area in a single column and 1 pixel group area in a single row. In this case, there would be 2,073,600 FIPEL panels each capable of emitting light at a preset color temperature and absolute color from any point on the CIE index. In this extreme scenario, the LCD panel would be eliminated and the FIPEL panels would be the individual light emitters eliminating sub-pixels from the display and result in two thirds fewer control gates to provide the same resolution display panel.

TABLE 2

Number of Possible Columns and Rows In a FIPEL Backlight

| Cols | Pixels Tile Col | Rows | Piixels Tile Row |
|---|---|---|---|
| 1 | 1,080 | 1 | 1,920 |
| 2 | 540 | 2 | 960 |
| 4 | 270 | 3 | 640 |
| 6 | 180 | 4 | 480 |
| 8 | 135 | 6 | 320 |
| 9 | 120 | 8 | 240 |
| 10 | 108 | 12 | 160 |
| 12 | 90 | 16 | 120 |
| 15 | 72 | 20 | 96 |
| 18 | 60 | 24 | 80 |
| 20 | 54 | 32 | 60 |
| 24 | 45 | 40 | 48 |
| 27 | 40 | 48 | 40 |
| 30 | 36 | 64 | 30 |
| 36 | 30 | 80 | 24 |
| 40 | 27 | 96 | 20 |
| 45 | 24 | 120 | 16 |
| 54 | 20 | 128 | 15 |
| 60 | 18 | 160 | 12 |
| 72 | 15 | 192 | 10 |
| 90 | 12 | 240 | 8 |
| 108 | 10 | 320 | 6 |
| 120 | 9 | 384 | 5 |
| 135 | 8 | 480 | 4 |
| 216 | 5 | 640 | 3 |
| 270 | 4 | 960 | 2 |
| 540 | 2 | 1920 | 1 |
| 1080 | 1 | | |

This technique can also be used with the new Samsung screen technology called Electro-wetting Displays which may have backlights or have only have reflective back surfaces that reflect ambient light. A FIPEL panel of the type shown in the embodiments can provide both. When the FIPEL panel is active with this type of display, the display is using a backlight. When the FIPEL panel is turned off, the reflective back surface of the FIPEL panel is reflective. This gives the Electro-wetting Display the best of both worlds.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended for cover any modification or alternatives which might be predictable to a person having ordinary skill in the art. For example, other sizes and thicknesses can be used.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments.

The various illustrative logical blocks, modules, and circuits described in connection with the embodiments disclosed herein, may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. The processor can be part of a computer system that also has a user interface port that communicates with a user interface, and which receives commands entered by a user, has at least one memory (e.g., hard drive or other comparable storage, and random access memory) that stores electronic information including a program that operates under control of the processor and with communication via the user interface port, and a video output that produces its output via any kind of video output format, e.g., VGA, DVI, HDMI, display port, or any other form. This may include laptop or desktop computers, and may also include portable computers, including cell phones, tablets such as the IPAD™, and all other kinds of computers and computing platforms.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, using cloud computing, or in combinations. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of tangible storage medium that stores tangible, non transitory computer based instructions. An exemplary storage medium is coupled to the processor such that the processor can read information from, and write information to, the storage medium. In the alternative, the storage medium may be integral to the processor. The processor and the storage medium may reside in reconfigurable logic of any type.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer.

The memory storage can also be rotating magnetic hard disk drives, optical disk drives, or flash memory based storage drives or other such solid state, magnetic, or optical storage devices. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media. The computer readable media can be an article comprising a machine-readable non-transitory tangible medium embodying information indicative of instructions that when performed by one or more machines result in computer implemented operations comprising the actions described throughout this specification.

Operations as described herein can be carried out on or over a website. The website can be operated on a server computer, or operated locally, e.g., by being downloaded to the client computer, or operated via a server farm. The website can be accessed over a mobile phone or a PDA, or on any other client. The website can use HTML code in any form, e.g., MHTML, or XML, and via any form such as cascading style sheets ("CSS") or other.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A display system, comprising an emissive body, divided into sections including at least first and second sections, and emitting light from at least one surface, said emissive body receiving a color temperature control from a frequency generator that controls multiple different color temperatures of said light, where each of the sections has their color temperature separately controlled by said color temperature control, and where a first section of the emissive body is controlled to output a first color temperature of light, and a second section of the emissive body, different than the first section of the emissive body, is controlled to output a second color temperature of light, different than said first color temperature of light; and a spatial light modulator, having multiple individual controllable pixels, said multiple pixels being illuminated by said emissive body, and said pixels each modulating the light from said emissive body to produce a display, where said first and second sections of said emissive body illuminate the spatial light modulator with different color temperatures in different areas including at least said first color temperature in said first section and said second color temperature in said second section, wherein the frequency generator driving said emissive body, to emit light at said multiple different color temperatures by changing a frequency emitted by the frequency generator, where the frequency of the frequency generator changes a white balance of its light output.

2. The display system as in claim 1, further comprising a plurality of registers storing separate color temperature values, a first of said separate color temperature values operating to adjust a first color temperature of the first section of said emissive body, and a second of said separate color temperature values operating to adjust a second color temperature of the second section of said emissive body.

3. The display system as in claim 2, further comprising an insulator separating said sections of the emissive body at a first surface, and said sections having a common second surface that is common to said sections.

4. The display system as in claim 1, further comprising a stream processor, analyzing digital content to be displayed, and setting the color temperature of each of said sections, including said first section having a different color temperature output than the second section, separately based on said digital content to be displayed.

5. The display system as in claim 4, wherein there are multiple different sections of said emissive body, and each of said multiple different sections is controlled separately to have separately-controlled color temperature output.

6. The display system as in claim 5, wherein said stream processor determines areas of program content on areas of said display that show black portions, and reduce an output level of backlight in sections that illuminate the areas of program content that show black portions.

7. The display system as in claim 5, wherein there are at least 24 sections of the emissive body that are separately controlled to each have individually controllable color temperatures of light.

8. The display system as in claim 1, further comprising driving said emissive body, to emit light at multiple different color temperatures.

9. The display system as in claim 1, further comprising multiple frequency generators, each frequency generator driving a section of said emissive body to emit light at a color temperature that depends on a frequency emitted by the each frequency generator, where the frequency of the frequency generator changes a white balance of a light output of a section of the emissive body.

10. A display system, comprising an emissive body, divided into multiple sections, said emissive body emitting light of separately controllable color temperatures from each of said multiple sections, and where a first section of the emissive body is controlled to output a first color temperature of light, and a second section of the emissive body, different than the first section of the emissive body, is controlled to output a second color temperature of light, different than said first color temperature of light;

a spatial light modulator, having multiple individual controllable pixels, said multiple pixels being illuminated by said multiple sections of said emissive body where the multiple pixels are illuminated by different color temperatures of light from the multiple sections, and said pixels collectively modulating the different color temperatures of light from said emissive body, to produce a display, a control, which controls white balance of said multiple sections of said emissive body, including at least said first and second sections, and controls said pixels of said spatial light modulator, to create the display, where said control includes a multiplexer receiving a white balance control providing separate outputs to control said white balance of said sections, wherein a frequency generator driving said emissive body, to emit light at said multiple different color temperatures by changing a frequency emitted by the frequency generator, where the frequency of the frequency generator changes a white balance of its light output.

11. The display system as in claim 10, where said control includes a multiplexer receiving a white balance control and a pixel control, and providing separate outputs to control said white balance of said sections and said pixels.

12. The display system as in claim 10, further comprising multiple frequency generators, each frequency generator driving a section of said emissive body to emit light at a color temperature that depends on a frequency emitted by the each frequency generator, where the frequency of the frequency generator changes a white balance of a light output of a section of the emissive body.

13. The display system as in claim 10, wherein said control includes a plurality of registers storing separate color temperature values, a first of said separate color temperature values operating to adjust a first color temperature of a first section of said emissive body, and a second of said separate color temperature values operating to adjust a second color temperature of a second section of said emissive body.

14. The display system as in claim 10, wherein said control includes a stream processor, analyzing digital content to be displayed, and setting a color temperature of each of said sections, including said first section having a different color temperature output of light than the second section, separately based on said digital content to be displayed.

15. The display system as in claim 14, wherein said stream processor determines areas of program content on areas of said display that show black portions, and reduces an output level of backlight in sections that illuminate the areas of program content that show the black portions.

16. The display system as in claim 10, further comprising an insulator separating said sections of the emissive body at a first surface, and said sections having a common second surface that is common to said sections.

17. A method of display, comprising driving sections of an emissive body to emit light toward a spatial light modulator to create a display, said driving including using a color temperature control receiving from a frequency generator to control multiple different color temperatures of said light for each of said sections and to separately control the color temperature of each said section separately using said color temperature control, including controlling a first section of the emissive body to output a first color temperature of light, and controlling a second section of the emissive body, different than the first section of the emissive body, to output a second color temperature of light, different than said first color temperature; and controlling pixels of the spatial light modulator to each modulate the light from said emissive body to produce a display; and driving said emissive body at a frequency to emit light at said multiple different color temperatures, where the frequency changes a white balance of an emitted light output.

18. The method as in claim 17, wherein said driving comprises reading values from a plurality of registers which store separate color temperature values, a first of said separate color temperature values operating to adjust a first color temperature of a first section of said emissive body, and a second of said separate color temperature values operating to adjust a second color temperature of a second section of said emissive body.

19. The method as in claim 17, further comprising analyzing digital content to be displayed, and setting the color temperature of each of said sections separately based on said digital content to be displayed.

20. The method as in claim 17, further comprising determining areas of program content on areas of said display that show black portions, and reducing an output level of backlight in sections that illuminate the areas of program content that show black portions.

21. The method as in claim 17, wherein there are at least 24 sections of the emissive body that are separately controlled.

22. The method as in claim 17, further comprising driving said sections of the emissive body at multiple frequencies to adjust a white balance of each section separately.

* * * * *